United States Patent [19]

Scott

[11] 3,998,195

[45] Dec. 21, 1976

[54] FLOW CONTROL AND VAPORIZING CHAMBER

[76] Inventor: Alfred E. Scott, 323 Aster Road, West Islip, N.Y. 11795

[22] Filed: Feb. 3, 1975

[21] Appl. No.: 546,805

[52] U.S. Cl. ..... 123/141; 48/180 R; 123/52 M

[51] Int. Cl.[2] ..... F02M 29/04

[58] Field of Search ..... 123/141, 52 M; 48/180 R, 180 M

[56] References Cited

UNITED STATES PATENTS

| | | | |
|---|---|---|---|
| 1,103,931 | 7/1914 | Bennett | 123/141 |
| 1,683,281 | 9/1928 | Asire | 123/141 |
| 1,798,492 | 3/1931 | Plourde | 123/141 |
| 2,701,557 | 2/1955 | Ramey | 123/141 |
| 3,735,744 | 5/1973 | Brody et al. | 123/141 |
| 3,826,235 | 7/1974 | Pasbrig | 123/141 |

FOREIGN PATENTS OR APPLICATIONS

| | | | |
|---|---|---|---|
| 686,479 | 1929 | Italy | 123/141 |

*Primary Examiner*—Charles J. Myhre
*Assistant Examiner*—Ira S. Lazarus
*Attorney, Agent, or Firm*—Richard L. Miller

[57] ABSTRACT

A flow control and vaporizing chamber comprising a cylindrical member containing a plurality of closely spaced, longitudinally extending tubes. The chamber is positioned in a vehicle engine between the carburetor and the intake manifold. The cylindrical member has an outer diameter which snugly fits into the intake manifold and a base which rests on the manifold frame. The longitudinally extending tubes receive the fuel-and-air mixture from the carburetor, break up the fuel in the mixture and direct the mixture to the cylinders.

10 Claims, 5 Drawing Figures

FLOW CONTROL AND VAPORIZING CHAMBER

BACKGROUND OF THE INVENTION

This invention relates to vehicle engines, and more particularly to improving the efficiency of an internal combustion engine.

A typical vehicle engine, especially of the internal combustion type, utilizes a plurality of cylinders which operate on a sequence whereby a fuel-and-air mixture is drawn into the cylinder, the mixture is then compressed, ignited by means of a spark plug, and the power stroke in the cylinder causes the shaft or rotor of the engine to receive a thrust. The efficiency of operation of the engine generally depends upon the amount of the mixture which explodes and the amount of thrust produced from this explosion. It is therefore of extreme importance to provide the proper mixture in the cylinder.

In order to produce the proper proportion of fuel and air in the mixture, a carburetor is utilized to form the mixture. In the carburetor, a stream of air is drawn into an induction pipe and is caused to pass a venturi section which increases the velocity of the air at that section while diminishing the static pressure. A tube leading from a fuel source is positioned at the venturi section such that as the air flows past the tube, a suction is developed causing the fuel to be sucked out of the tube and be atomized. Tiny droplets of fuel are carried along into the pipe by the air stream.

The carburetor is connected to the intake manifold which directs the fuel-and-air mixture to the cylinders for combusiton. The air intake pipe as well as the manifold is kept close to sources of heat, which helps to vaporize the fuel droplets in the flow of air. The function of the carburetor can, therefore, be summarized as; discharging into the air stream the desired amount of fuel; atomizing the fuel; and making a suitable proportion of air-and-fuel mixtures.

One of the major problems of internal combustion engines is to provide an efficient engine which can produce sufficient power and at the same time utilize as little gas fuel as possible. With increased energy supply problems, the reduction in the use of fuel has become a most critical problem in the operation of automobile engines.

It is therefore an object of the present invention to provide a vehicle engine having an improved efficiency.

A further object of the present invention is to provide a vehicle engine which can increase the amount of miles per gallon obtained over comparable vehicle engines known in the prior art.

Still a further object of the present invention is to provide a flow control and vaporizing chamber inserted between the carburetor and the intake manifold of a vehicle engine which improves the efficiency of operation of the vehicle.

Another object of the present invention is to provide a flow control and vaporizing chamber in conjuction with the carburetor of a vehicle which serves to break up the fuel in the mixture, enrich the fuel-air mixture and conduct heat to the mixture thereby obtaining a more complete vaporization of the fuel which is fed into the intake manifold.

Another object of the present invention is to provide a flow control and vaporizing chamber positioned between the vehicle carburetor and the intake manifold which produces a directionalized flow of the vapor to the cylinders of the engine.

Still a further object of the present invention is to provide a flow control and vaporizing chamber which does not utilize any moving parts, and improves the efficiency of operation of a vehicle.

A further object of the present invention is to provide improved efficiency in a vehicle engine in a simple, inexpensive and efficient manner.

Yet another object of the present invention is to provide improvement in the efficiency of operation of a vehicle engine by utilizing a flow control and vaporizing chamber which can be applied to new vehicles as well as retrofitted to existing vehicles.

These and other objects, features and advantages of the invention will, in part, be pointed out with particularity and will, in part, become obvious from the following more detailed description of the invention, taken in conjunction with the accompanying drawings which form an integral part thereof.

SUMMARY OF THE INVENTION

Briefly, the invention describes a flow control and vaporizing chamber for use in a vehicle engine having a carburetor which produces a fuel-and-air mixture, and an intake manifold coupled to the carburetor for distributing the mixture to the cylinders for combustion. The flow control and vaporizing chambers is positioned at the connection between the carburetor and the manifold and comprises, a cylindrical member positioned immediately beneath the carburetor whose outer diameter snugly fits into the intake manifold and whose base rests on the manifold frame. A plurality of closely spaced longitudinally extending tubes are positioned within the cylindrical member for receiving the fuel-and-air mixture from the carburetor, breaking up the fuel in said mixture, and directing the mixture to the cylinders.

In one embodiment of the invention, the cylindrical member is formed of a solid cylindrical material and the longitudinally extending tubes are circular in shape and formed within the solid material. The solid cylindrical member includes a center bar extending longitudinally throughout the length of the cylindrical member. In another embodiment the cylindrical member is a hollow tube and the longitudinal tubes are hexagonal cells formed into a honeycomb pattern and coupled within the inside of the hollow tube. The base of the cylindrical member can be formed into a V-shape or into a four-sided prism.

BRIEF DESCRIPTION OF THE DRAWINGS

In the Drawing.

In the various figures of the drawing, like reference character designate like parts.

DESCRIPTION OF THE PREFERRED EMBODIMENTS

Figure 1:
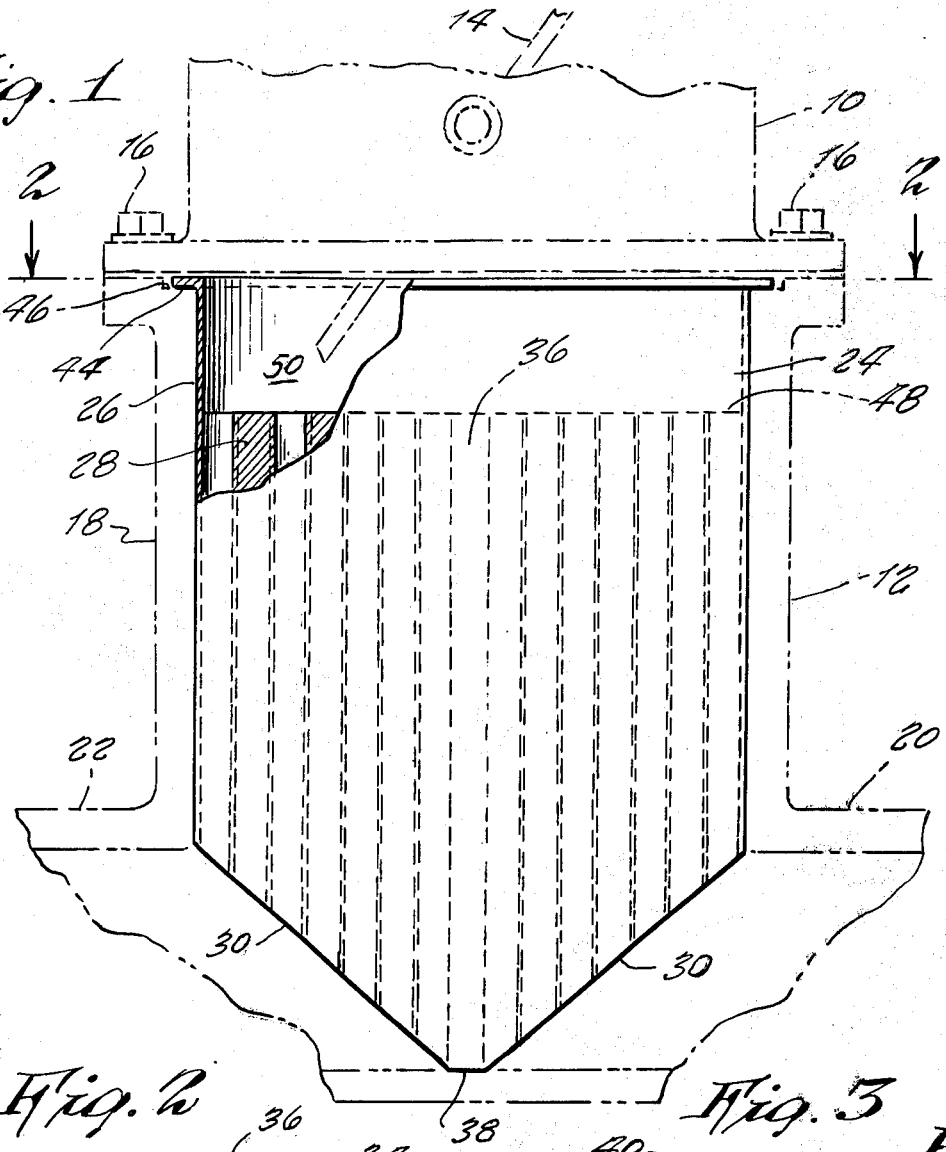
FIG. 1 is a side elevational view, partially cut away, of an embodiment of the invention showing the chamber coupled between the intake manifold and the carburetor.

As is well known in the operation of an internal combustion engine, the carburetor produces the fuel-and-air mixture needed for the operation of the engine and is coupled to the intake manifold which receives the mixture and distributes it to the cylinders. Referring now to FIG. 1 there is shown, in dotted lines, the generally well known existing portions of an engine, including the carburetor shown generally at 10 and the intake manifold shown generally at 12. The carburetor includes a throttle valve 14 of the well known butterfly type which can control the amount of the mixture which is sent to the cyliders. The carburetor is coupled by means of the bolts 16 directly to the frame of the intake manifold. The manifold includes a first vertical portion 18 and then splits off into the manifold arms 20, 22 which feed the cyliners.

Positioned between the carburetor and the intake manifold is the flow control and vaporizing chamber, in accordance with one embodiment of the present invention, shown generally at 24. The chamber includes a cylindrical member 26 whose outer diameter is made to snugly fit within the vertical section 18 of the intake manifold. The cylindrical member includes a plurality of closely spaced, longitudinally extending tubes 28 positioned from the carburetor and into the intake manifold end. The bottom portion of the chamber is shown cut away at 30 to form a V-shape and both the cylindrical member as well as the longitudinal tubes follow the V-shape at the bottom of the chamber.

Figure 2:
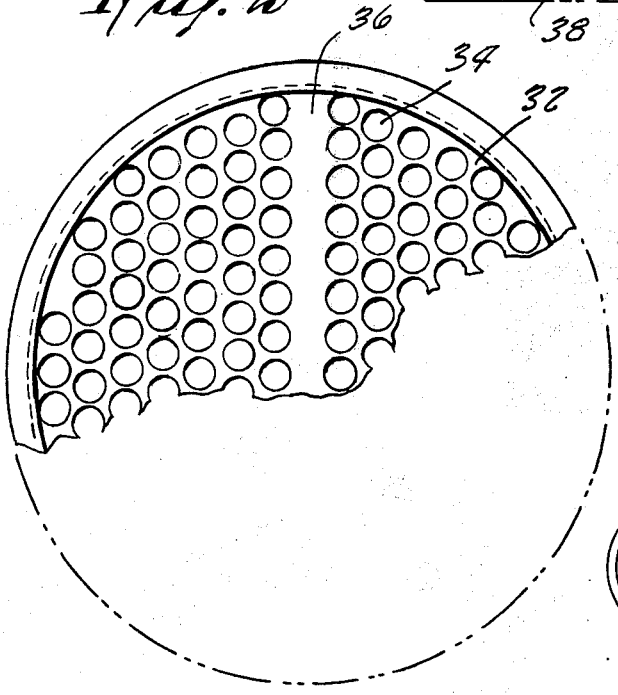
FIG. 2 is a fragmentary top view taken along line 2-2 of FIG. 1.

Referring now to FIG. 2 there is shown one embodiment of forming the cylindrical member and the longitudinal tubes. The cylindrical member is shown as a solid unit 32 having the longitudinal tubes 34 drilled or machined through the solid cylinder. By way of example, ⅛ inch diameter holes are drilled, maintaining a distance of 0.005 included as a wall thickness between the holes. A solid bar 36 is maintained at the central diameter of the cylindrical member such that the bar extends downwards to the bottom part of the V whereby the solid bar contacts the manifold frame at 38 (FIG. 1). By way of example, the solid center bar is approximately ¼ inch thick.

Figure 3:
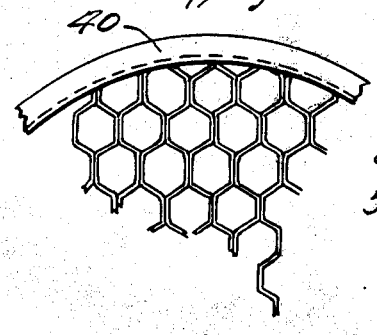
FIG. 3 is a fragmentary top view of another embodiment of the present invention.

An alternate embodiment of the construction of the chamber is shown in FIG. 3. The cylindrical member is a sleeve 40 while each of the longitudinally extending tubes are formed as a hexagonal shaped cell 42. The hexagonal cells 42 are fitted together into a honeycomb pattern which is coupled inside the cylindrical sleeve. Typically, the cell width is 3/16 inch utilizing 5 mill material to form the walls of the cylindrical cells. When the honeycomb pattern is used, the sleeve will be cut at an angle shown in FIG. 1 and the angle cut will contact the manifold frame. The honey comb pattern will typically have a heavy coating of engine enamel or lacquer baking which is coated at approximately 400° F. The rim thickness of the cylindrical member will typically be approximately 1/16 inch wide.

Figure 4:
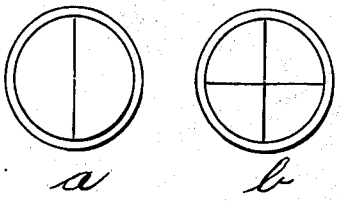
FIG. 4 is a bottom view showing diagramatically various shapes of the bottom shape of the chamber, in accordance with the present invention.

The bottom of the chamber of the present invention is shaped to provide suitable directional flow into the various manifold pipes. FIG. 1 shows the V-shaped bottom. However, other shapes can be also utilized depending upon the manifold construction. For example, referring now to FIG. 4a, there is again shown the V-shape base which would be utilized for 2, 4, 6 and straight 8 cylinder engines. The four-sided prism bottom shown in FIG. 4b would be suitable for a V-8 type of engine.

Referring again to FIG. 1 there is shown that the top portion of the cylindrical member is formed with an outwardly extending lip 44 which sits on a shelf 46 at the top of the intake manifold. This provides a secure fit and retains the chamber in place when the lower portion of the carburetor is fitted against the lip 44. It is also noted that a recess is provided in the upper portion of the chamber to permit the movement of the butterfly valve 14 into the recess. The recess if formed by spacing the longitudinally extending tubes at a distance from the top portion of the cylindrical member. As shown, the cylindrical tubes commence from a line 48 which is spaced from the top portion of the chamber 50.

Figure 5:
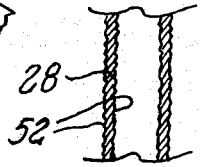
FIG. 5 is a fragmentary side elevation view of one of the longitudinal tubes shown in FIG. 1.

By positioning the flow control and vaporizing chamber of the present invention between the carburetor and the intake manifold tubes, the air-and-fule mixture from the carburetor passes downward through the longitudinally extending tubes and are then directed to the various manifold pipes by means of the bottom shaped portion of the chamber. The flow control and vaporizing chamber of the present invention therefore serve to break down the raw fuel into minute particles, thereby further atomizing them and enriching the fuel-and-air mixture. The flow control and vaporizing chamber also serves to conduct heat to the mixture thereby effecting a more complete vaporization of the fuel. For this purpose, aluminium has been found effective for providing the necessary heat transfer to the mixture. By shaping the bottom of the chamber of the present invention, there is also achieved a more directionalized flow of the vapor to the cylinders through the manifold pipes. In order to achieve an improvement in the breakdown and atomization of the fuel the internal surface of the longitudinally extending tubes should contain a roughness which further aids in the breaking down of the fuel. Referring now to FIG. 5, there is shown a section of one of the longitudinal tubes 28, and there is shown the rough surface 52 at the inside diameter thereof.

The size of the chamber of the present invention can be made to accomodate various existing intake manifolds and in this manner it can be either fitted into newly manufactured vehicles as well as being retrofitted into existing vehicles.

The present invention has been found to increase the efficiency of an automobile by as much as 100%. Thus, by way of example, a vehicle which normally operates at 10 miles per gallon, when utilizing the flow control and vaporizing chamber of the present invention has been found to operate by as much as 20 miles per gallon.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a vehicle engine having a carburetor to produce a fuel-and-air mixture and an intake manifold having a plurality of manifold arms, said intake manifold coupled to the carburetor for distributing said mixture to the cylinders for combustion, a flow control and vaporizing chamber positioned at the coupling between the carburetor and the manifold and comprising, a cylindrical member located immediately beneath the carburetor, said cylindrical member including a trunk portion and a base portion, the outer diameter of said trunk portion snugly fitting into the intake manifold and at least a part of said base portion resting on the inside of the manifold frame, and a plurality of closely spaced longitudinally extending tubes located within said cylindrical member for receiving said fuel-and-air mixture from the carburetor and breaking up the fuel in said mixture, and wherein said base portion is shaped to provide an angular face at each manifold arm, the bottoms of said tubes terminating at said faces for directing the mixture to the cylinders.

2. The combination of claim 1 and wherein said cylindrical member comprises a solid cylinder, and said longitudinally extending tubes are circular in shape and formed in said solid cylinder.

3. The combination of claim 2 and wherein the circular tubes each have a diameter of approximately ⅛ inch and are spaced from each other by approximately 0.005 inch.

4. The combination of claim 1 and wherein said cylindrical member is a hollow tube, and said longitudinally extending tubes are hexagonal cells formed into a honeycomb pattern and coupled to the inside of said hollow tube.

5. The combination of claim 4 and wherein each of said cells are approximately 3/16 inch wide with a wall thickness of about 5 mills, and said hollow tube has a wall thickness of about 1/16 inch.

6. The combination of claim 1 and wherein said base portion is formed into a V-shape.

7. The combination of claim 1 and wherein said base portion is formed into a four-sided prism.

8. The combination of claim 1 and wherein said cylindrical member includes a solid center bar extending longitudinally therein the bottom thereof resting on the manifold frame.

9. The combination of claim 1 and wherein said chamber is of aluminum material, wherein the top of said longitudinally extending tubes commence within said cylindrical member at a point spaced from the top of said cylindrical member, thereby forming a hollow recess in the top part of said chamber, and wherein said cylindrical member includes a lip portion at the top thereof adapted to fit over the top edge of the intake manifold.

10. The combination of claim 1 and wherein the inside of said longitudinally extending tubes contains a roughened surface.

* * * * *